US006857289B1

(12) United States Patent
Cheng

(10) Patent No.: US 6,857,289 B1
(45) Date of Patent: Feb. 22, 2005

(54) PRECIOUS STONE SETTING

(76) Inventor: Yuan-I Cheng, PO Box 82-144, Taipei (TW)

( * ) Notice: Subject to any disclaimer, the term of this patent is extended or adjusted under 35 U.S.C. 154(b) by 43 days.

(21) Appl. No.: 10/630,718

(22) Filed: Jul. 31, 2003

(51) Int. Cl.[7] ..... A44C 17/02
(52) U.S. Cl. ..... 63/31; 63/26
(58) Field of Search ..... 63/3–3.2, 5.1, 63/15–15.9, 26–32; D11/89–92

(56) References Cited

U.S. PATENT DOCUMENTS

| | | | | | |
|---|---|---|---|---|---|
| 1,548,646 | A | * | 8/1925 | Akeson | 63/15 |
| 3,959,989 | A | * | 6/1976 | Bhandia | 63/15.65 |
| 4,187,697 | A | * | 2/1980 | Castelo | 63/31 |
| 4,220,017 | A | * | 9/1980 | Freeman | 63/15 |
| 4,294,084 | A | * | 10/1981 | Lampert | 63/15 |
| 4,796,442 | A | * | 1/1989 | Sarcona | 63/26 |
| 5,950,456 | A | * | 9/1999 | Kirsch, Jr. | 63/31 |
| 6,324,869 | B1 | * | 12/2001 | Vanlioglu | 63/31 |
| 6,612,132 | B2 | * | 9/2003 | Kimura et al. | 63/31 |

FOREIGN PATENT DOCUMENTS

| | | | |
|---|---|---|---|
| CH | 634 475 | * | 2/1983 |
| FR | 2 734 996 | * | 12/1996 |
| JP | 2001000217 | * | 1/2001 |
| WO | WO 02/065868 | * | 8/2002 |

* cited by examiner

*Primary Examiner*—Robert J. Sandy
*Assistant Examiner*—Ruth C. Rodriguez
(74) *Attorney, Agent, or Firm*—Leong C. Lei

(57) ABSTRACT

A precious stone setting is disclosed. The setting comprises a shank body, a collect and an external rim. The circumferential edge of the shank body is provided with an inwardly contracting cavity and the inner wall of the recessed cavity is provided with a groove. The precious stone is positioned at the collet having two pivotal shafts protruded into shaft holes preset at the inner side of the external rim to form a rotatable connection. The external side of the external rim, between two shaft holes, has two perpendicularly extended pivot shafts and are insertable into the groove of the body. The precious stone is free to pivotally rotate in accordance with the position of the external rim, the branch shaft of the collet and in combination of the rotating of the external rim within the groove the precious stone is provided with sloping swinging angle and direction accordingly to the movement of the shank so as to provide aesthetic appearance.

5 Claims, 3 Drawing Sheets

PRECIOUS STONE SETTING

BACKGROUND OF THE INVENTION (a) Technical Field of the Invention

The present invention relates to precious stone setting, and in particular, a collet for precious stone having two protruded branch shafts to insert into shaft holes at the inner edge of an external rim, and the circumferential edge of the external rim, between two shaft holes, is protrudingly provided with a branch shaft for mounting into groove formed on the shank. The collet and the branch shafts of the external rim move in accordance with positions of the directions of the shank to provide different pivoting, and swinging angle, forming into variations of configuration.

(b) Description of the Prior Art

Conventional precious stone setting has a collet having a cavity to receive directly a precious stone. The circumferential edge of the opening of the cavity is provided with a plurality of corresponding prongs. The precious stone is positioned on the cavity and a plurality of prongs hold the circumferential edge of the precious stone so that the precious stone is firmly mounted to the shank. However, generally the surface of the precious stone (or diamond) having undergone a cutting process, is provided with reflective surfaces of various sloping and to give a glittering effect. However, generally, there is a best visual angle of the precious stone setting to show the best external appearance of the precious stone. The conventional precious stone setting structure is always has a fixed position and if the shank is moved or rotated, the aesthetic appearance of the precious stone may not be seen and/or appreciated due to the change of the sloping of the reflective surface. In view of the above drawback, it is an object of the present invention to provide a precious stone setting which can mitigate the above drawback.

SUMMARY OF THE INVENTION

Accordingly, it is an object of the present invention to provide a precious stone setting comprises a shank body, a collet and an external rim. The circumferential edge of the shank body is provided with an inwardly recessed contracting cavity and the inner wall of the recessed cavity is provided with a groove. The precious stone is positioned at the collet having two pivotal shafts protruded into shaft holes preset at the inner side of the external rim to form a rotatable connection. The external side of the external rim, between two shaft holes, has two perpendicularly extended pivotal shafts and insertable into the groove of the shank body. The precious stone is free to pivotally rotate in accordance with the position of the external rin, the branch shafts of the collet in combination of the rotating of the external rim within the groove the precious stone is provided with sloping swinging angle and direction accordingly to the movement of the shank so as to provide an aesthetic appearance.

Still another object of the present invention is to provide a precious stone setting, wherein when the center of gravity of the precious stone changes, glittering effect is obtained and a pleasant visual effect is achieved.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
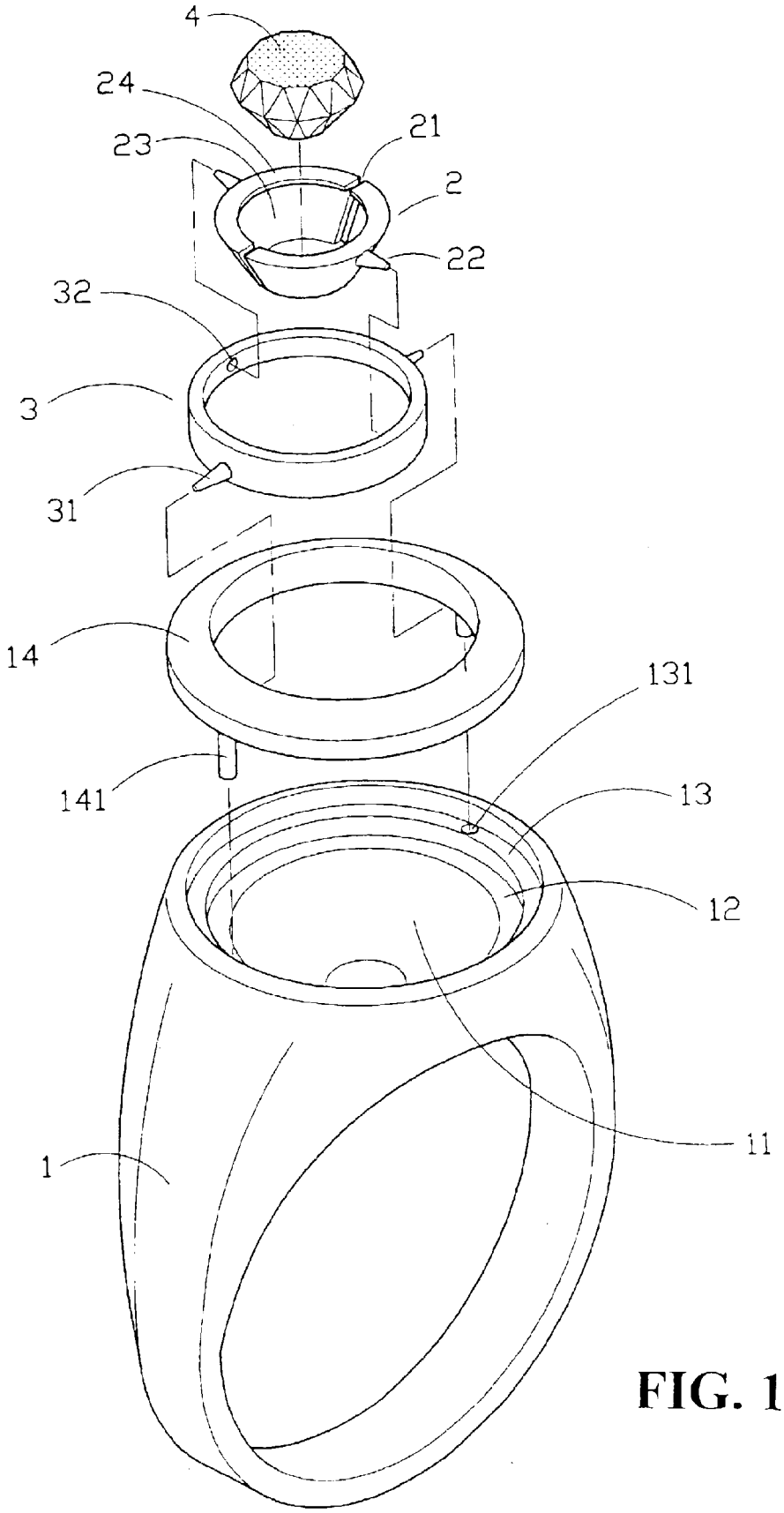
FIG. 1 is a perspective exploded view of a precious stone setting of the present invention.

FIG. 1 is a perspective exploded view of the present invention. As can be seen from the figure, the precious stone setting comprises a shank 1, a collet 2 and an external rim 3. The circumferential edge of the shank 1 is a recessed cavity 11 having an inner circumferential edge mounted externally in sequence a stepped first recessed edge 12, a second recessed edge 13, and the bottom face of the second recessed edge 13 is provided with a plurality of insertion holes 131 for the mounting of pegs 141 provided correspondingly at a mounting rim 14 for positioning. The center of the collet 2 is provided with an upward opened cavity 23 for the placement of a precious stone 4. The circumferential edge of the cavity 23 is provided with two gaps 21 which are perpendicularly extended so that the lateral wall of the circumferential edge of the cavity 23 is divided into two portions. The inner edge of the top side of the opening of the cavity 23 has an inwardly bent pressing edge 24. The circumferential edge of the collet 2 has two corresponding external protruded branch shafts 22, and the external rim 3 is hollow and the inner edge is provided with two shaft holes 32. The external circumferential edge, between two shaft holes 32, is externally and perpendicularly protruded with two branch shafts 31 such that the two branch shafts 31 and the two branch shafts 32 are separated at 90 degree.

Figure 2:
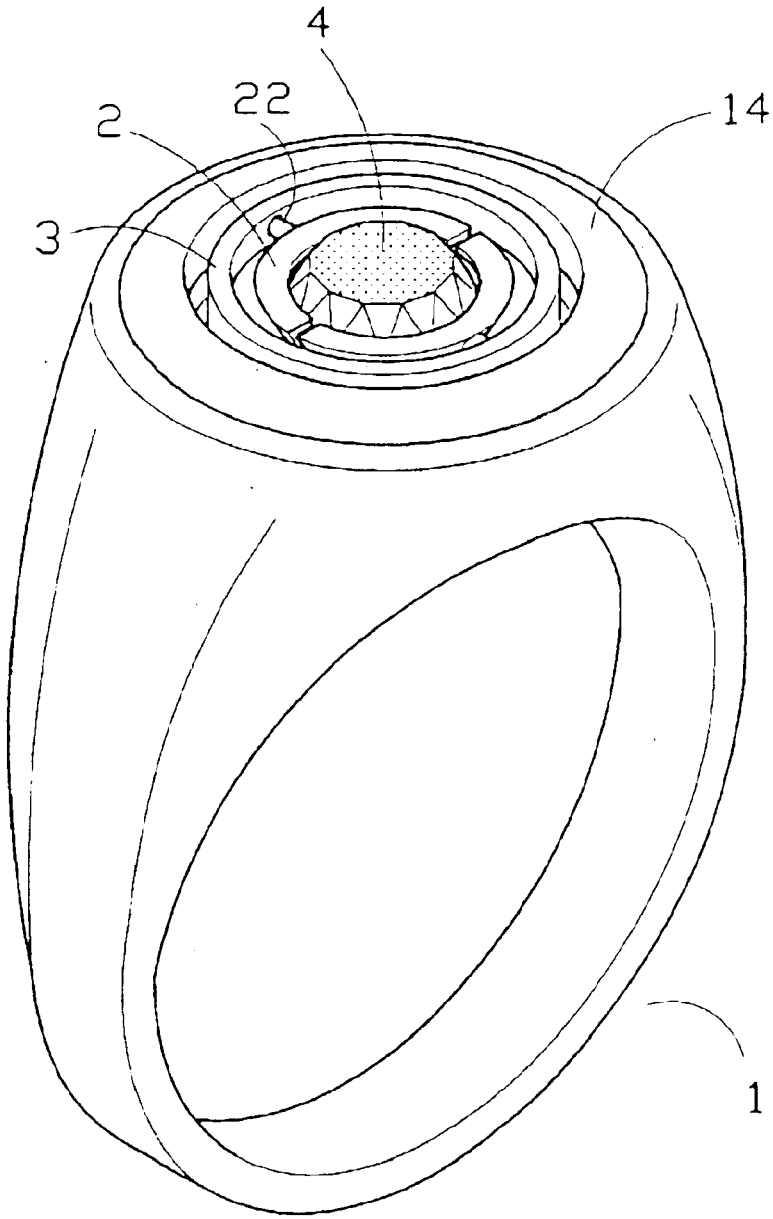
FIG. 2 is a perspective view of the precious stone setting in accordance with the present invention.
Figure 3:
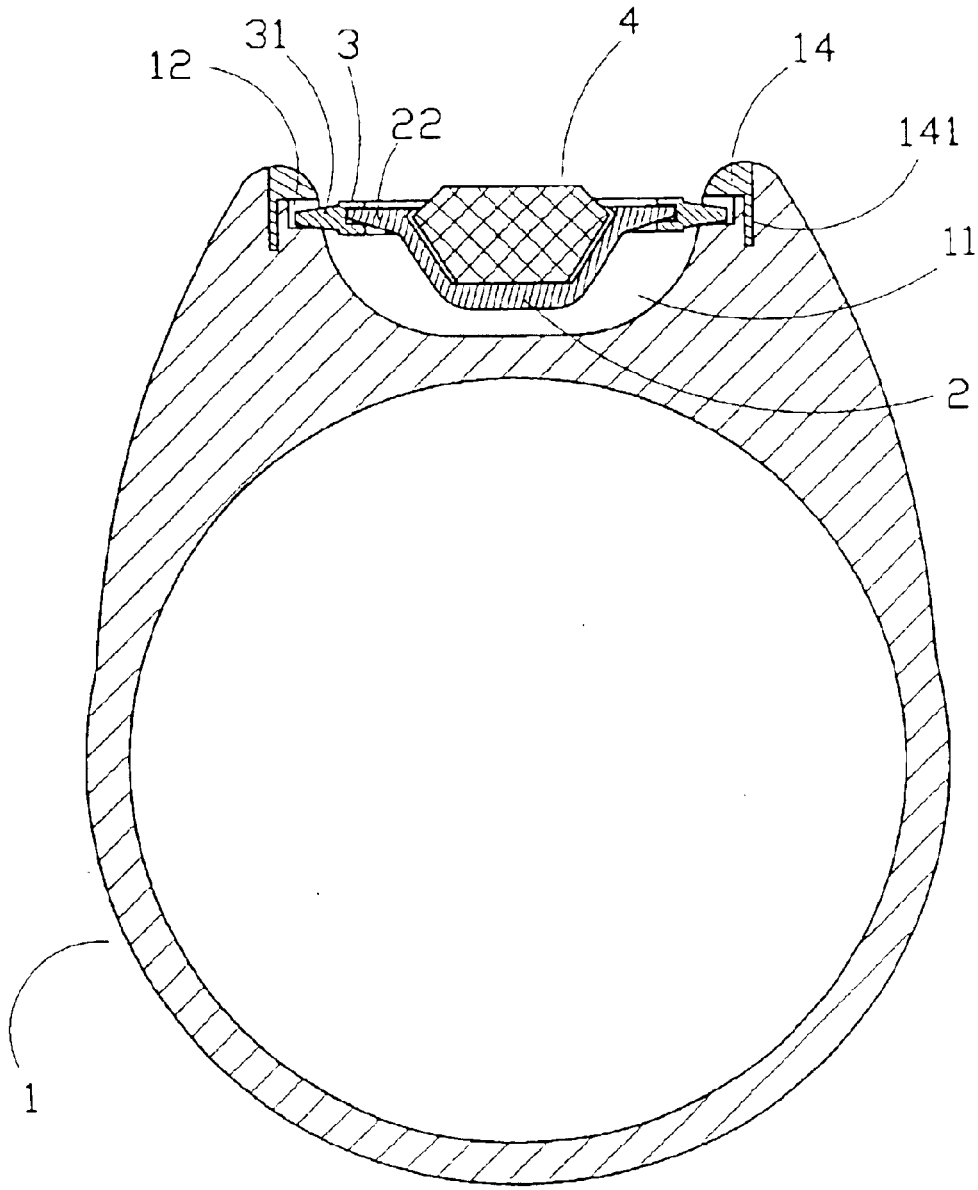
FIG. 3 is a sectional view of the precious stone setting in accordance with the present invention.

Referring to FIG. 2, there is shown a perspective view of the present invention. FIG. 3 is a sectional view of the precious stone setting. The gaps 21 can be expanded so as to adjust the size of the cavity 23 to recess the precious stone 4, and the pressing edge 24 is used to engage the circumferential edge at the top side of the precious stone. The two branch shafts 24 of the collet 2 can be respectively inserted into the two shaft holes 32 of the external rim 3 to form a pivotal connection. The external rim 3 employs two branch shafts 31 to protrude into the first recessed edge 12 of the shank 1, and the positioning peg 141 of the mounting rim 14 is inserted into the positioning insertion hole 131 of the second recessed edge 13 such that the branch shaft 31 can be placed at the first recessed edge 12 (groove) covered by the mounting rim 14.

The collet 2 is pivotally rotating with the branch shaft 22 as the axis about the external rim 3, and the external rim 3 can be pivotally rotated using the branch shaft 31 as the axis. The pivotal rotating axis of the external rim 3 and the collet 2 are perpendicular to each other, and the branch shaft 31 of the external rim 3 slidably rotates within the first recessed edge 12 of the shank 1. Thus, when the shank 1 changes its angle, direction, the precious stone 4 will change its center of gravity and an appropriate corresponding inclination is obtained. Due to the fact that the branch shaft 22 of the collet is substantially passing through the position of the center of gravity, the precious stone 4 will swing when there is a change in inclination angle and position, and the precious stone 4 will produce a reciprocating movement to provide a glittering visual effect.

Further, the gap 21 of the collet 2 can be expanded or extended with respect to space to expose the beauty and texture of the circumferential edge of the precious stone 4. The gap can also fully cover the defect of the circumferential edge of the precious stone 4.

In view of the above, the precious stone setting of the present invention provides a precious stone multiple angle of pivotal rotation so as to give an aesthetic visual appearance to the precious stone.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A precious stone setting comprising:

(a) a shank body with a circumferential edge having a recessed cavity with internal wall corresponding to a first and a second recessed edge extended upwardly, the upper section of the second recessed edge being mounted with a mounting rim such that the lower section of the first recessed edge is formed into a groove;

(b) an external rim being a hollow rim with an inner edge correspondingly mounted with two shaft hole with external circumferential edge at the center of the shaft hole being mounted with two externally protruded branch shafts and the two branch shaft being insertable into the groove of the shank body to form into a combination which is rotatable and pivotable;

(c) a collet having an upward opened cavity for a precious stone, the circumferential wall of the cavity being provided with two corresponding perpendicularly extended gaps and the circumferential edge of the collet being mounted with two outwardly protruded branch shafts which respectively extend into the two shaft holes at the inner edge of the external rim to form into another free-to-pivot combination;

whereby by utilizing the pivotal axis of the branch shaft of the collet and the external nm being perpendicularly, and the branch shaft of the external rim is rotatable along the groove of the shank body, the sloping angle of the precious stone changes according to the change of position of the shank body to provide an aesthetic appearance.

2. The precious stone setting of claim 1, wherein the branch shaft of the collet via the position of the center of gravity of the precious stone changes the sloping angle to cause the stone 4 to glitter.

3. The precious stone setting of claims 1, wherein the bottom face of the second recessed edge is provided with a plurality of insertion holes for the mounting of the pegs correspondingly mounted to the mounting rim.

4. The precious stone setting of claim 1, wherein the top side of the opening of the cavity of the collet is provided with an inwardly protruded pressing edge for the positioning of the circumferential edge of the top side of the precious stone.

5. The precious stone setting of claim 1, wherein the two gaps of the collet is extendable to form a large setting space to show the texture and beauty of the circumferential edge of the precious stone.

* * * * *